US006390663B1

(12) United States Patent
Civardi

(10) Patent No.: US 6,390,663 B1
(45) Date of Patent: May 21, 2002

(54) MIXING MACHINE FOR MIXING OR AMALGAMATING VARNISHES, PAINTS AND THE LIKE

(75) Inventor: Luigi Civardi, Pavia (IT)

(73) Assignee: Meccanica Civardi S.r.l., Pavia (IT)

( * ) Notice: Subject to any disclaimer, the term of this patent is extended or adjusted under 35 U.S.C. 154(b) by 0 days.

(21) Appl. No.: 09/765,646

(22) Filed: Jan. 22, 2001

(51) Int. Cl.[7] ..... B01F 9/00
(52) U.S. Cl. ..... 366/217; 366/605
(58) Field of Search ..... 366/110, 111, 366/208–211, 213, 214, 217, 219, 605

(56) References Cited

U.S. PATENT DOCUMENTS 3,284,057 A * 11/1966 Duquette
3,880,408 A * 4/1975 Karjalainen
4,146,335 A * 3/1979 Hutchings et al.
4,281,936 A * 8/1981 Schotter et al.
4,415,270 A * 11/1983 Heinis et al.
4,445,782 A * 5/1984 Sparrow, Jr.
4,789,245 A * 12/1988 Morbeck
5,197,802 A * 3/1993 Miller et al.
5,261,744 A * 11/1993 Brunn
5,458,416 A * 10/1995 Edwards et al.
5,507,575 A * 4/1996 Rossetti
5,788,371 A * 8/1998 Neri et al.
5,906,433 A * 5/1999 Mazzalveri

FOREIGN PATENT DOCUMENTS

DE 2809513 * 9/1979
EP 478212 * 4/1992
WO 91/08045 * 6/1991

* cited by examiner

*Primary Examiner*—Charles E. Cooley
(74) *Attorney, Agent, or Firm*—Stevens, Davis, Miller & Mosher, LLP

(57) ABSTRACT

Mixing machine (10) for mixing or amalgamating varnishes, paints and the like comprising two coaxial shafts (14, 15) each one being operated by an electric motor (18, 20), a support (36) for a rotatable lower cap (29) that can be manually moved forward to load a can of varnish and cooperating with a top support (35) carrying a rotatable upper cap (28) to secure the can. The shaft (14) transmits the motion to the upper cap to turn the container about its longitudinal axis; the shaft (15) transmits its motion to a spindle (32) provided with worms (33, 34) in the ends thereof to approach or move away the caps. A fork (39) operated by the shaft (14) turns the caps about an axis which is perpendicular to the axis of the can of varnish. The can is therefore rotated about its longitudinal axis when secured between the lower cap and the upper cap and the can is turned about an axis which is perpendicular to the longitudinal axis of the can.

8 Claims, 2 Drawing Sheets

MIXING MACHINE FOR MIXING OR AMALGAMATING VARNISHES, PAINTS AND THE LIKE

BACKGROUND OF THE INVENTION

1. Field of the Invention

The present invention relates to a mixing machine for mixing or amalgamating varnishes, paints and the like.

2. Description of the Related Art

In the past manufacturers had been producing a lot of cans of varnishes or paints in several tonalities of color and therefore a big store was required to provide room for the cans and also the dealer should have enough room to keep that variety of cans with all the different tonalities.

In order to obviate all this, the dealer keeps some basic colors in the shop and prepares the desired tonality there and then, using suitable batching machines. In order to get this result, it is not enough to fill a can with definite percentages of basic colors, but the colors must be amalgamated by means of suitable machines which will mix the filled can.

In variety stores, where a lot of paints of the same tonality are packed and sold, some mechanical mixers are used, the mixers being inserted into the filled cans and thus amalgamating the different basic paints by the rotatory motion of the blade.

This method is useful just for the variety stores and for the preparation of a lot of varnishes or paints of the same tonality; in fact, at every change of color or tonality the mixer must be replaced by a clean one and it takes a long time to replace and clean the mixer, so that the production cost notably increases if the amount of varnish or paint is very small.

In small stores or shops smaller mixers are used, in which a motor operates, by means of a belt, a pulley which transmits the motion to various pairs of gears in order to turn, like a gyroscope, the can of varnish secured between two caps that can slide along four vertical pilot bars. The mass that is turned is very big and therefore a quite powerful motor is required to turn everything and prevail over the various frictions. The complicated construction of the different parts and the motor high power increase the production costs.

The present invention intends to overcome the above mentioned inconveniences.

SUMMARY OF THE INVENTION

The technical problem to be solved consists in performing a simple mixing machine, with few parts and therefore not very expensive and reliable with little rotating masses.

The technical solution provides two coaxial shafts operated by an electric motor, a lower cap support that can be manually moved forward to load a can of varnish and cooperating with a top cap support to hold the can, the former being provided to transmit the motion from one of the shafts to the top cap and turn the can on itself, the latter teeing provided to transmit the motion from the other shaft to the caps and draw them nearer and firmly hold the can and turn it around an axis which is perpendicular to its own axis.

BRIEF DESCRIPTION OF THE DRAWINGS

Further features and advantages will be more apparent from the description and the accompanying drawings in which.

DETAILED DESCRIPTION OF THE PREFERRED EMBODIMENT(S)

Figure 1:
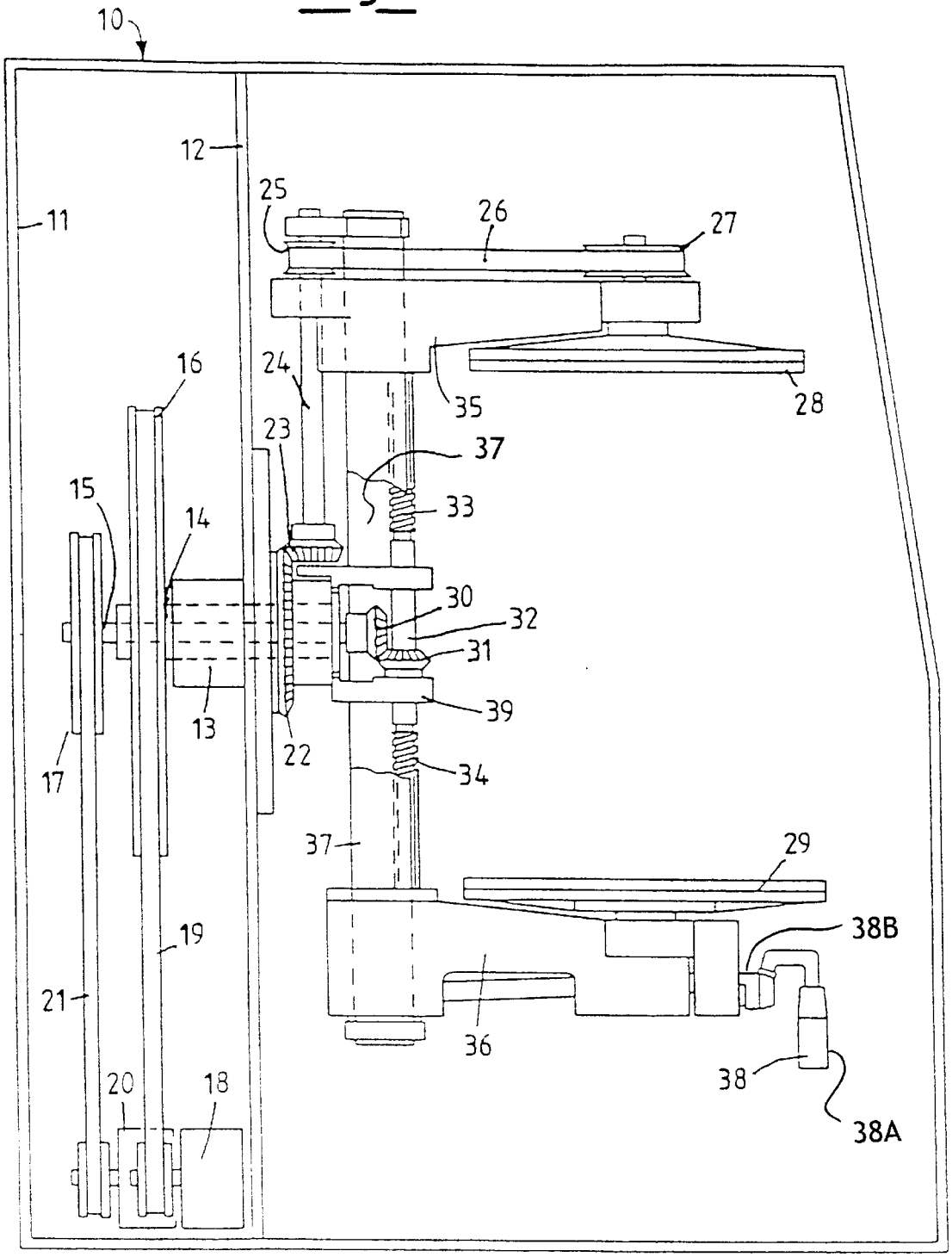
FIG. 1 is a side view of the machine of the present invention.

With reference to FIG. 1, 10 generically indicates a mixing machine for mixing or amalgamating varnishes or paints including a frame 11 provided with a vertical inside surface 12 to which a bush 13 is fixed and which is provided with two coaxial shafts 14 and is with pulleys 16 and 17 fixed to them. The pulley 16 is operated by an electric motor 18 which transmits the motion by means of a belt 9; the pulley 17 is operated by a second electric motor 20 by means of a belt 21. The shaft 14, which is operated by the pulley 16, supports a bevel gear 22 connected to a second gear 23 which operates a pulley 25 by means of a spindle 24; the pulley 25 is connected to a pulley 27 by means of a belt 26; the pulley 27 is connected to a rotatable top cap 28 which turns when a can filled with varnish to be mixed is loaded, as will be more apparent from the ensuing description. The bevel gear 22 and the shaft 14 are coaxial.

The rotatable top cap 28 cooperates with a rotatable lower cap 29 on which the can of varnish is placed.

The shaft 15, operated by the pulley 17, carries a gear 30 in the other end; the gear 30 is connected to a gear 31 to have a shaft 32 turned, on which worms 33 and 34 are placed in the ends, the worms coupled to supports 35 and 36 which carry the cap 28 and the cap 29, respectively.

Two guides 37 direct the vertical motion of the supports 35 and 36 to prevent them from turning.

The cap 29 is manually moved forward in the direction of the arrow A (FIG. 2) by turning a handle 38A of a cotter 38 (FIGS. 1 and 2) to load the can of varnish.

Figure 2:
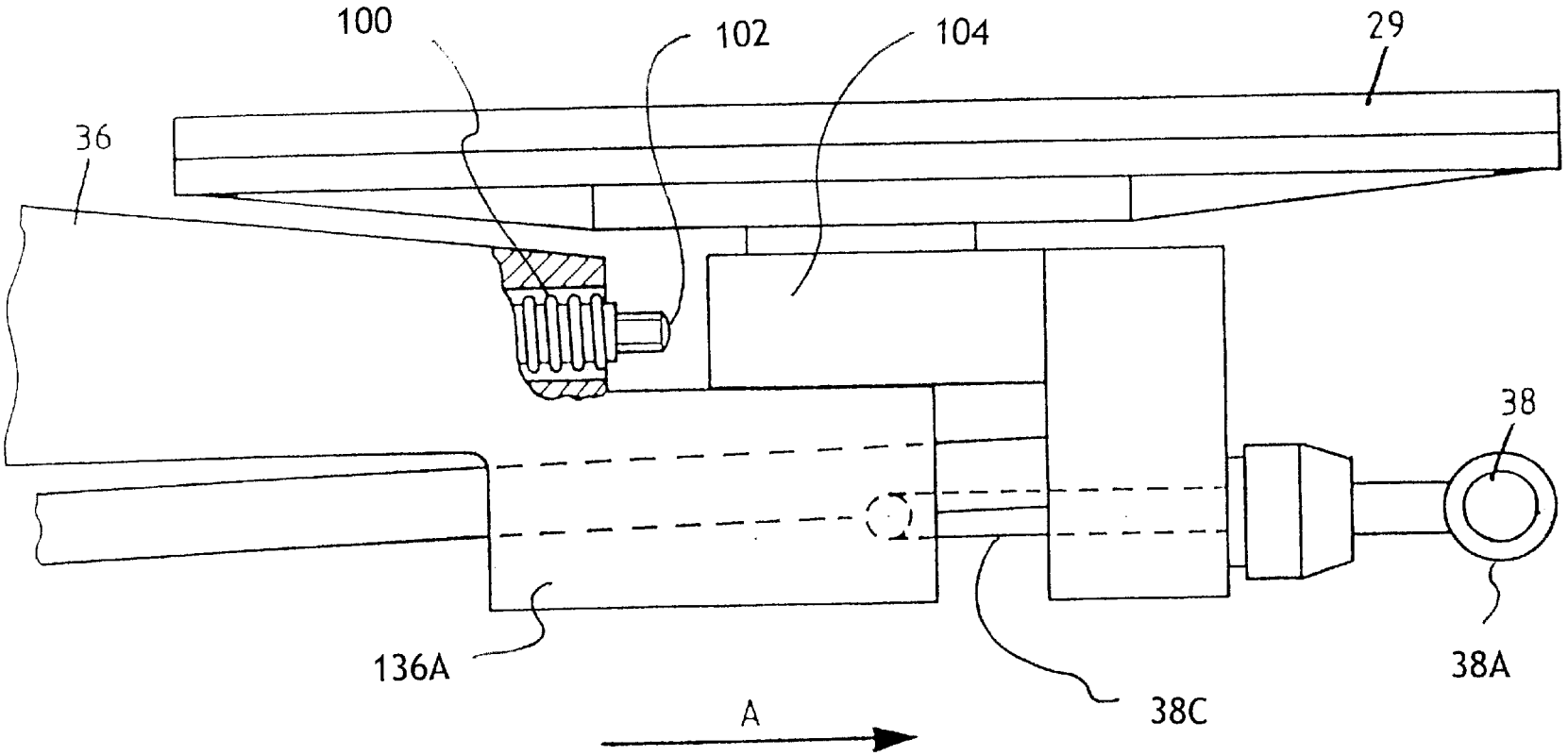
FIG. 2 shows a detail of the machine of FIG. 1.

The support 36 has a first base portion 104 and a second portion 136A. The cotter 38, when turned allows the lower cap 29 to move. When locked the cotter 38 secures the lower cap 29 in a locked position (FIG. 1). The cotter 38 also has a shaft 38C projecting into the support 36. When in the position shown in FIG. 1, a projection 388 of the cotter contacts the first base portion 104 to hold the first base portion 104 in place. In contrast, in FIG. 2, the cotter 38 has its handle 38A in a position at a right angle to its position in FIG. 1. Thus, in FIG. 2 the projection 38B is hidden. A worm 100, shown in FIG. 2, provides a projection 102 for the first base portion 104 to contact when the lower cap 29 is pushed back. Moreover, FIG. 1 shows the caps 28, 29 aligned in an operating position, whereas FIG. 2 shows the first base portion 104 moved distally, relative to the operating position, to a position for loading the can.

After the container is placed on the cap 29, the cap is pushed back opposite to the direction of the arrow A until the cotter 38 secures the cap 29. Thus, the cap 29 is mounted for sliding movement on the support 36 between a loading position (FIG. 2) and an operating position (FIG. 1). Then the rotor 20 is operated and the caps 28 and 29 approach by means of the kinematic chain belt 21, the pulley 17, the shaft 15, the gear 30, the gear 31, the shaft 32, the worms 33 and 34, until the can of varnish is secured between the caps.

After the can of varnish is secured between the caps 28 and 29, the motor 18 is operated and it causes the cap 28 to turn about its axis by means of the shaft 14, the spindle 24 and the belt 26 and so the can of varnish rotates around a longitudinal axis of the can.

While the can is secured between the caps 28 and 29, the motor 18 is operated which drives belt 19 to rotate pulley 16 which rotates shaft 14. The shaft 14 is also connected to and operates a fork 39 which rotates and transmits rotary motion to the supports 35 and 36 such that the caps 28 and 29 and supports 35 and 36 turn around the horizontal axis of the shaft 14. While the fork 39 is rotated by the shaft 14 the gear 23 meshes with bevel gear 22 to rotate gear 23 which actuates spindle 24, pulley 25, belt 26 and pulley 27 to rotate top cap 28.

The can of varnish is made to turn around its horizontal axis by means of the motor drive 18 and also around the horizontal axis of shaft 14 by means of the motor drive 18, the horizontal axis being perpendicular to the longitudinal axis of the can.

The combining rotations get the varnish uniformly mixed or amalgamated in the can.

The machine achieving this is compact, easily made with few parts to secure the can and with two perpendicular motions to get a perfect mixing.

The present invention is defined by the claims appended hereto in which I claim the following.

What is claimed is:

1. Mixing machine for mixing or amalgamating varnishes or paints in a can, comprising:

first and second shafts, wherein the first shaft is coaxial to the second shaft, a first electric motor to operate the first shaft, a second electric motor to operate the second shaft, a lower cap, an upper cap, a support for the lower cap and a support for the upper cap, wherein the lower cap is rotatably mounted on the lower cap support, the upper cap is rotatably mounted on the upper cap support, the lower cap support having a first portion and a second portion, and the first portion of the lower cap support is manually movable from an operating position, in which the upper cap and lower cap are aligned, forward distally, relative to the second portion of the lower cap support, to a distal position for loading a can, and wherein the lower cap support cooperates with the upper cap support carrying the upper cap to be in a first position to secure the can between the lower cap and the upper cap, first means for transmitting motion from the first shaft to the upper cap to turn the can around a longitudinal axis of the can when secured between the lower cap and the upper cap in the first position and for turning the can around an axis which is perpendicular to the longitudinal axis of the can, and second means for transmitting motion from the second shaft to said caps to cause the lower cap to approach the upper cap and secure the can in the first position.

2. Mixing machine according to claim 1, wherein the first means for transmitting comprises a first bevel gear coaxial to the first shaft and connected to a second bevel gear fixed to an end of a third shaft supporting a first pulley connected to a second pulley by a belt, the second pulley being connected to the upper cap and the upper cap being turned by the first coaxial shaft when the can is secured in the first position between the upper cap and the lower cap.

3. Mixing machine according to claim 1, wherein the second means comprises:

a gear fixed to the second coaxial shaft and cooperating with a gear fixed to a shaft on which two worms are placed in the ends thereof which cooperate respectively with the cap supports to move the caps from a second position to the first position to secure the can of varnish or paint and move the caps from the first position to the second position to free the can when the varnish or paint is amalgamated.

4. Mixing machine according to claim 3, wherein a fork is provided on the first shaft to transmit the rotary motion of the first shaft to the cap supports to turn the can around the axis which is perpendicular to the longitudinal axis of the can, wherein the fork is provided about the wormed shaft.

5. Mixing machine according to claim 3, wherein a fork is provided on the first shaft to transmit the rotary motion of the first shaft to the cap supports to turn the can around the axis which is perpendicular to the longitudinal axis of the can, wherein the fork is coupled to the cap supports.

6. Mixing machine according to claim 1, further comprising guides to guide the supports as the supports move between the first position and the second position, the guides being provided to prevent the supports from turning.

7. Mixing machine according to claim 1, wherein the lower cap is provided with a cotter to move the cap distally relative to the second portion of the lower cap support to a distal position for loading the can, the cotter when turned allowing the tower cap to move and the cotter having a locked position to secure the cap in the operating position.

8. Mixing machine according to claim 1, wherein a fork is provided on the first shaft to transmit the rotary motion of the first shaft to the cap support to turn the can around the axis which is perpendicular to the longitudinal axis of the can.

* * * * *